US011717120B2

(12) United States Patent
Mathieu et al.

(10) Patent No.: US 11,717,120 B2
(45) Date of Patent: Aug. 8, 2023

(54) ROBOTIC CLEANER

(71) Applicant: SHARKNINJA OPERATING LLC, Needham, MA (US)

(72) Inventors: Margaret Mathieu, East Greenwich, RI (US); Justin West, Needham, MA (US)

(73) Assignee: SharkNinja Operating LLC, Needham, MA (US)

( * ) Notice: Subject to any disclaimer, the term of this patent is extended or adjusted under 35 U.S.C. 154(b) by 93 days.

(21) Appl. No.: 17/116,528

(22) Filed: Dec. 9, 2020

(65) Prior Publication Data

US 2021/0186282 A1 Jun. 24, 2021

Related U.S. Application Data

(60) Provisional application No. 62/945,684, filed on Dec. 9, 2019.

(51) Int. Cl.
*A47L 9/04* (2006.01)
*A47L 9/00* (2006.01)

(52) U.S. Cl.
CPC ..... *A47L 9/0477* (2013.01); *A47L 9/009* (2013.01); *A47L 9/0494* (2013.01); *A47L 2201/04* (2013.01)

(58) Field of Classification Search
CPC ..... A47L 9/0494; A47L 2201/04; A47L 9/28; A47L 9/2805; A47L 9/2836; A47L 9/2889
USPC ..... 15/383
See application file for complete search history.

(56) References Cited

U.S. PATENT DOCUMENTS 5,760,390 A 6/1998 Vezzalini et al.
8,452,450 B2 5/2013 Dooley et al.
9,211,045 B2 * 12/2015 Li ..... A47L 11/4058
2004/0204792 A1 * 10/2004 Taylor ..... G05D 1/0274 700/245
2007/0100500 A1 * 5/2007 Abramson ..... A47L 9/0483 701/2
2015/0208891 A1 7/2015 Jang et al.
2016/0015233 A1 * 1/2016 Uphoff ..... A47L 9/0455 134/6
2016/0320777 A1 11/2016 Yun
2017/0001311 A1 * 1/2017 Bushman ..... A47L 9/2826
(Continued)

FOREIGN PATENT DOCUMENTS

JP 2019201754 A 11/2019
KR 20030013008 A 2/2003

OTHER PUBLICATIONS

PCT Search Report and Written Opinion dated Feb. 26, 2021, received in corresponding PCT Application No. PCT/US20/63981, 10 pages.

*Primary Examiner* — Anne M Kozak
*Assistant Examiner* — Tyler James McFarland
(74) *Attorney, Agent, or Firm* — Grossman Tucker Perreault & Pfleger, PLLC

(57) ABSTRACT

A robotic cleaner may include a housing, an agitator, and one or more projections. The housing may have a front side, a back side opposite the front side, a left side, and a right side opposite the left side. The right and left sides extend between the front and back sides. The agitator may be configured to rotate about an agitator rotation axis, the agitator rotation axis extending substantially parallel to the front side. The one or more projections may extend from the housing. The one or more projections may include one or more cliff sensors.

4 Claims, 14 Drawing Sheets

(56) References Cited

U.S. PATENT DOCUMENTS

| | | | | |
|---|---|---|---|---|
| 2018/0169863 | A1 | 6/2018 | Bushman et al. | |
| 2018/0338656 | A1 | 11/2018 | Carter et al. | |
| 2018/0360281 | A1* | 12/2018 | Shin | A47L 9/04 |
| 2019/0038107 | A1* | 2/2019 | Jang | A47L 11/4044 |
| 2019/0090705 | A1 | 3/2019 | Thorne et al. | |
| 2020/0367715 | A1 | 11/2020 | Doughty et al. | |

* cited by examiner

ROBOTIC CLEANER

CROSS-REFERENCE TO RELATED APPLICATIONS

The present application claims the benefit of U.S. Provisional Application Ser. No. 62/945,684 filed on Dec. 9, 2019, entitled Robotic Cleaner with Edge Cleaning, which is fully incorporated herein by reference.

TECHNICAL FIELD

The present disclosure relates to autonomous devices and, more particularly to, robotic cleaners.

BACKGROUND INFORMATION

Robotic cleaners have become an increasingly popular appliance for automated cleaning applications. In particular, robotic vacuum cleaners are used to vacuum surfaces while moving around surfaces with little or no user interaction. Robotic vacuum cleaners include a suction system. Robotic vacuum cleaners may also include one or more cleaning implements such as one or more agitators (e.g., rotating brush rolls) and/or one or more side brushes.

BRIEF DESCRIPTION OF THE DRAWINGS

These and other features and advantages will be better understood by reading the following detailed description, taken together with the drawings wherein.

DETAILED DESCRIPTION

The present disclosure is generally directed to a robotic cleaner. The robotic cleaner includes a housing and an agitator (e.g., a brush roll). The agitator may be configured to rotate about an agitator rotation axis that extends substantially parallel to a front side of the housing and to a surface to be cleaned (e.g., a floor). In some instances, one or more projections may extend from the housing. The one or more projections may include one or more cliff sensors that are configured to detect a non-traversable drop-off (or cliff) in the surface to be cleaned.

Additionally, or alternatively, in some instances, the robotic cleaner may include one or more spiral brushes. The one or more spiral brushes rotate about a spiral brush rotation axis that extends substantially parallel to the surface to be cleaned and transverse to (e.g., perpendicular to) the agitator rotation axis. Additionally, or alternatively, in some instances, the agitator may be configured to move along one or more of a drop axis and/or a forward bump axis. Movement along the drop axis is indicative of a presence of a non-traversable drop-off in the surface to be cleaned (or cliff) and movement along the forward bump axis is indicative of the presence of an obstacle.

As used herein, the terms "above" and "below" are used relative to an orientation of the cleaning apparatus on a surface to be cleaned and the terms "front" and "back" are used relative to a direction that the cleaning apparatus moves on a surface being cleaned during normal cleaning operations. As used herein, the term "leading" refers to a position in front of at least another component but does not necessarily mean in front of all other components.

Figure 1:
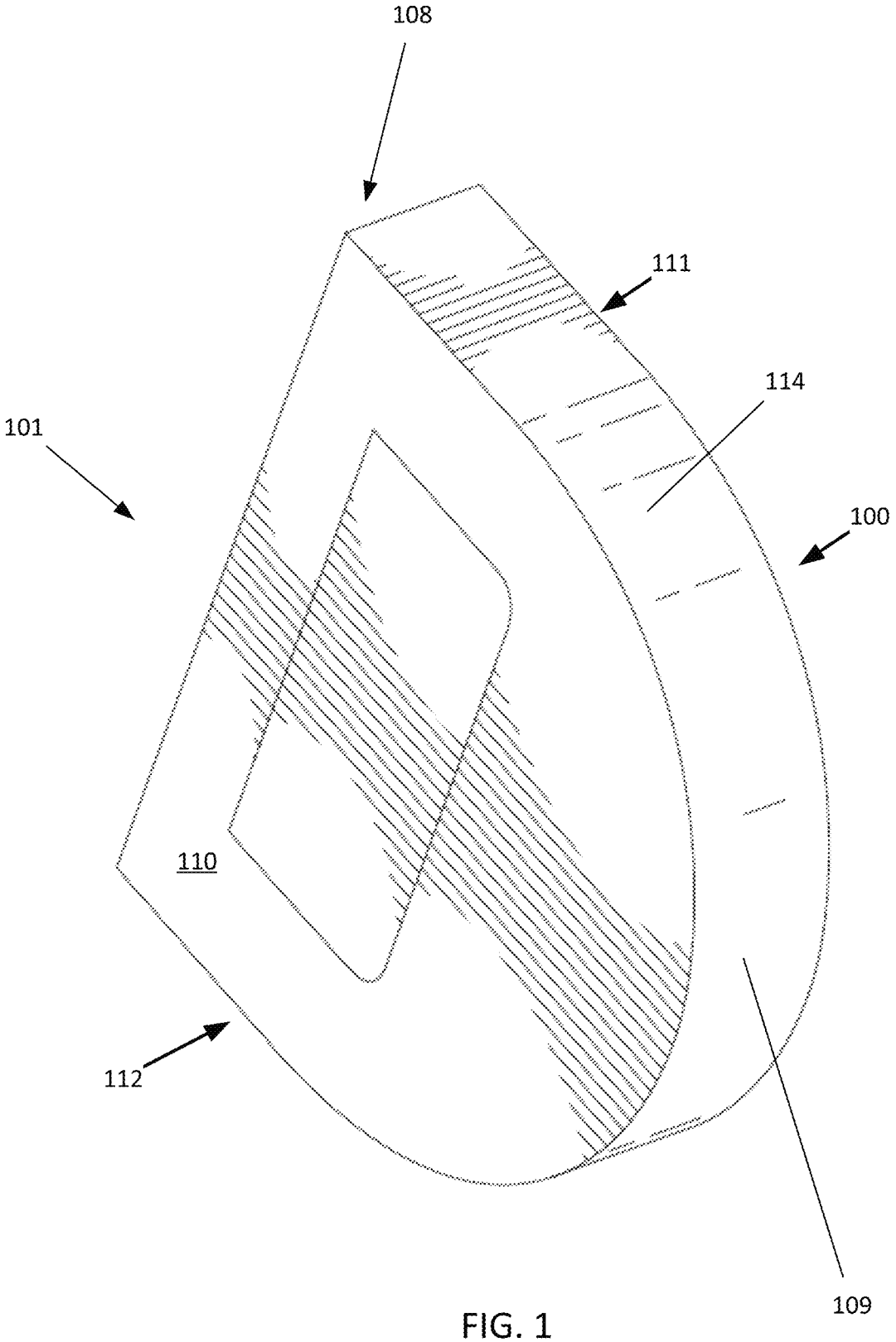
FIG. 1 is a perspective view of a robotic cleaner, consistent with embodiments of the present disclosure.

FIG. 1 shows a perspective schematic view of an example of a robotic cleaner 101, consistent with embodiments of the present disclosure. Although a particular embodiment of a robotic cleaner 101 is shown and described herein, the concepts of the present disclosure may apply to other types of robotic cleaners.

As shown, the robotic cleaner 101 includes a housing 100 having a front side 108, a back side 109 that is opposite the front side 108, a left side 112, a right side 114 that is opposite the left side 112, an upper side (or top surface) 110, and an underside (or bottom surface) 111 that is opposite the top surface 110. The left and right sides 112 and 114 extend between the front and back sides 108 and 109. The back side 109 may have an arcuate shape (e.g., wherein the arc extends in a direction away from the front side 108) and the front side 108 may have a substantially planar shape. As such, in some instances, the housing 100 may generally be described as having a "D-shape." While the robotic cleaner 101 is shown as having a D-shaped housing other configurations are possible. For example, the housing 100 may be round, oval, hexagonal, triangular, trapezoidal, and/or any other shape.

A user interface may extend along and/or define at least a portion of the top surface 110. The user interface may include, for example, one or more indicators (e.g., one or more displays, one or more light emitting diodes, and/or any other indicator) configured to indicate a status of the robotic cleaner 101 (e.g., current operational mode, battery charge level, errors, and/or any other status), one or more inputs (e.g., buttons) configured to cause the robot to engage in one or more operations (e.g., autonomous cleaning, spot cleaning, docking, and/or any other operation), and/or any other feature of a user interface.

Figure 2:
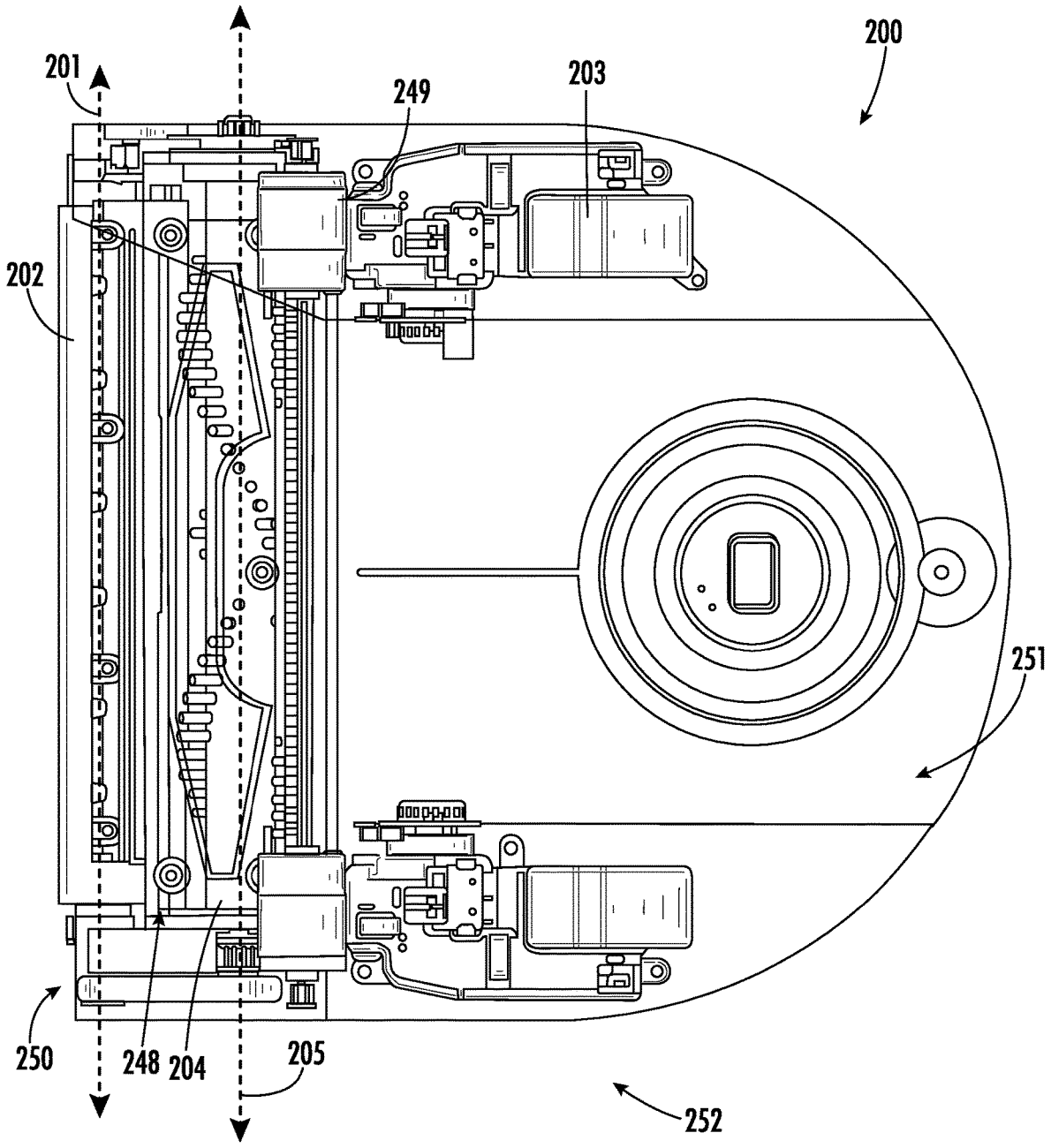
FIG. 2 is a bottom view of an example of the robotic cleaner shown in FIG. 1, consistent with embodiments of the present disclosure.

FIG. 2 shows a bottom view of a robotic cleaner 200, which may be an example of the robotic cleaner 101 of FIG. 1. As shown, the robotic cleaner 200 includes a first agitator 202 and a second agitator 204 (e.g., a brush roll). In some instances, the first agitator 202 may have a different construction from the second agitator 204 (e.g., the first agitator 202 may comprise a microfiber and/or velvet material and the second agitator 204 may comprise one or more bristles and/or flaps).

The first agitator 202 may have bristles, fabric, or any other cleaning element, or any combination thereof. In one example, a microfiber or velvet fabric may extend around the first agitator 202. The first agitator 202 may also be removable to allow first agitator 202 to be cleaned more easily, allow the user to change the size of the first agitator 202, change the type of bristles on the first agitator 202, and/or remove the first agitator 202 entirely depending on the intended application.

The second agitator 204 may have bristles, fabric, or any other cleaning element, or any combination thereof. In one example, the second agitator 204 may include one or more strips of bristles in combination with one or more strips (or flaps) of a rubber or elastomer material. The second agitator 204 may also be removable to allow second agitator 204 to be cleaned more easily, allow the user to change the size of the second agitator 204, change the type of bristles on the second agitator 204, and/or remove the second agitator 204 entirely depending on the intended application.

In operation, the first and second agitators 202 and 204 are configured to rotate about a corresponding agitator rotation axis 201 and 205. The rotation axes 201 and 205 may extend substantially (e.g., within 1°, 2°, 3°, 4°, or 5° of) parallel to each other and/or extend substantially parallel to a surface to be cleaned. As such, the rotation axes 201 and 205 may, in some instances, be generally described as horizontal rotation axes. The first and second agitators 202 and 204 may be co-rotating or counter rotating. As shown, in some instances, one or more of the rotation axes 201 and/or 205 may extend substantially parallel to a front side 250 of a housing 252 of the robotic cleaner 200.

The first and second agitators 202 and 204 can be configured to rotate about the rotation axes 201 and 205 such that debris on a surface to be cleaned is urged towards a dirty air (or debris) inlet defined with an agitator chamber (or suction conduit) 248. The agitator chamber 248 may define a cavity within which the first and second agitators 202 and 204 are at least partially disposed. The cavity may have one or more open ends through which at least a portion of one or more of the agitators 202 and 204 may extend. The cavity may further be coupled to the dirty air inlet. At least one open end of the cavity may be defined in a bottom surface 251 of the housing 252 of the robotic cleaner 200.

The dirty air inlet is fluidly coupled to a debris collector (or dust cup) and to a suction source (e.g., a suction motor) such that at least a portion of debris urged towards the dirty air inlet becomes entrained within air flowing into the dirty air inlet. At least a portion of the entrained debris may be deposited within the debris collector. The debris collector may be removably coupled to the housing 252 of the robotic cleaner 200 such that debris may be emptied therefrom. Rotation of the first and second agitators may be caused using one or more motors 249 (e.g., AC or DC motors). The one or more motors may be coupled to the first and second agitators 202 and 204 using one or more drive belts, one or more gears, and/or any other drive mechanism.

As shown, the first agitator 202 extends from the front side 250 of the housing 252 of the robotic cleaner 200. As such, the first agitator 202 may define a forward most portion of the robotic cleaner 200. In this example, the first rotation axis 201 may be positioned forward of the second rotation axis 205 such that, for example, the first rotation axis 201 extends between the front side 250 and the second rotation axis 205. While the first agitator 202 is shown as being forward of the second agitator 204, other configurations are possible. For example, the first agitator 202 may be positioned rearward of the second agitator 204. In this example, the second agitator may define a forward most portion of the robotic cleaner 200. Further, while the robotic cleaner 200 is shown as having a first and second agitator 202 and 204, other configurations are possible. For example, the robotic cleaner 200 may include only one of the first or second agitators 202 and 204 and/or include additional agitators.

The robotic cleaner 200 also includes wheels 203 configured to be driven by one or more drive motors. The wheels 203 support the housing 252 at a position spaced apart from a surface to be cleaned and are configured to urge the robotic cleaner 200 across the surface to be cleaned in response to actuation of the one or more drive motors. The wheels 203 may be independently driven such that a direction of motion of the robotic cleaner 200 can be controlled through differential rotation of the wheels 203. The wheels 203 may be mounted on respective suspension systems that bias the wheels in a direction away from the housing 252 (e.g., towards an extended position). For example, the suspension system may include a suspension arm pivotally coupled to the housing 252 such that the suspension arm is capable of transitioning between a retracted position and an extended position. The suspension system may further include a biasing mechanism (e.g., a spring) that urges the suspension arm towards the extended position. In some instances, one or more of a respective drive motor and/or a respective gearbox for transferring rotational movement from the drive motor to a respective wheel 203 may be coupled to the suspension arm. As such, the motor and/or gearbox may move with the suspension arm.

During operation, a weight of the robotic cleaner 200 causes the suspension systems of the respective wheels 203 to be in an intermediate position, the intermediate position being between the extended and retracted positions. A location of the intermediate position, relative to the extended and retracted positions, may vary based, at least in part, on the surface to be cleaned. The robotic cleaner 200 may also include wheel drop sensors (e.g., switches engaged by the suspension arm) to detect when the wheels are in the extended position.

The robotic cleaner 200 may include a controller configured to monitor sensor data (e.g., from one or more obstacle sensors, one or more floor type sensors, and/or any other sensors) and to control operation of the robotic cleaner 200 (e.g., based on the sensor data). For example, the controller may be communicatively coupled to one or more driving mechanisms (e.g., drive wheel motors, agitator motors, side brush motors, and/or any other driving mechanism) and one or more sensors. The controller can operate the drive motors, which drive the wheels, according to known techniques in the field of robotic cleaners. The controller may also cause the robotic cleaner 200 to perform various operations such as autonomous cleaning (including randomly moving and turning, wall following, and obstacle following), spot cleaning, and docking. The controller may also cause the robotic cleaner 200 to avoid obstacles and cliffs and to escape from various situations where the robotic cleaner 200 may become stuck. The controller may include any combination of hardware (e.g., one or more microprocessors) and software known for use in mobile robots.

Figure 3:
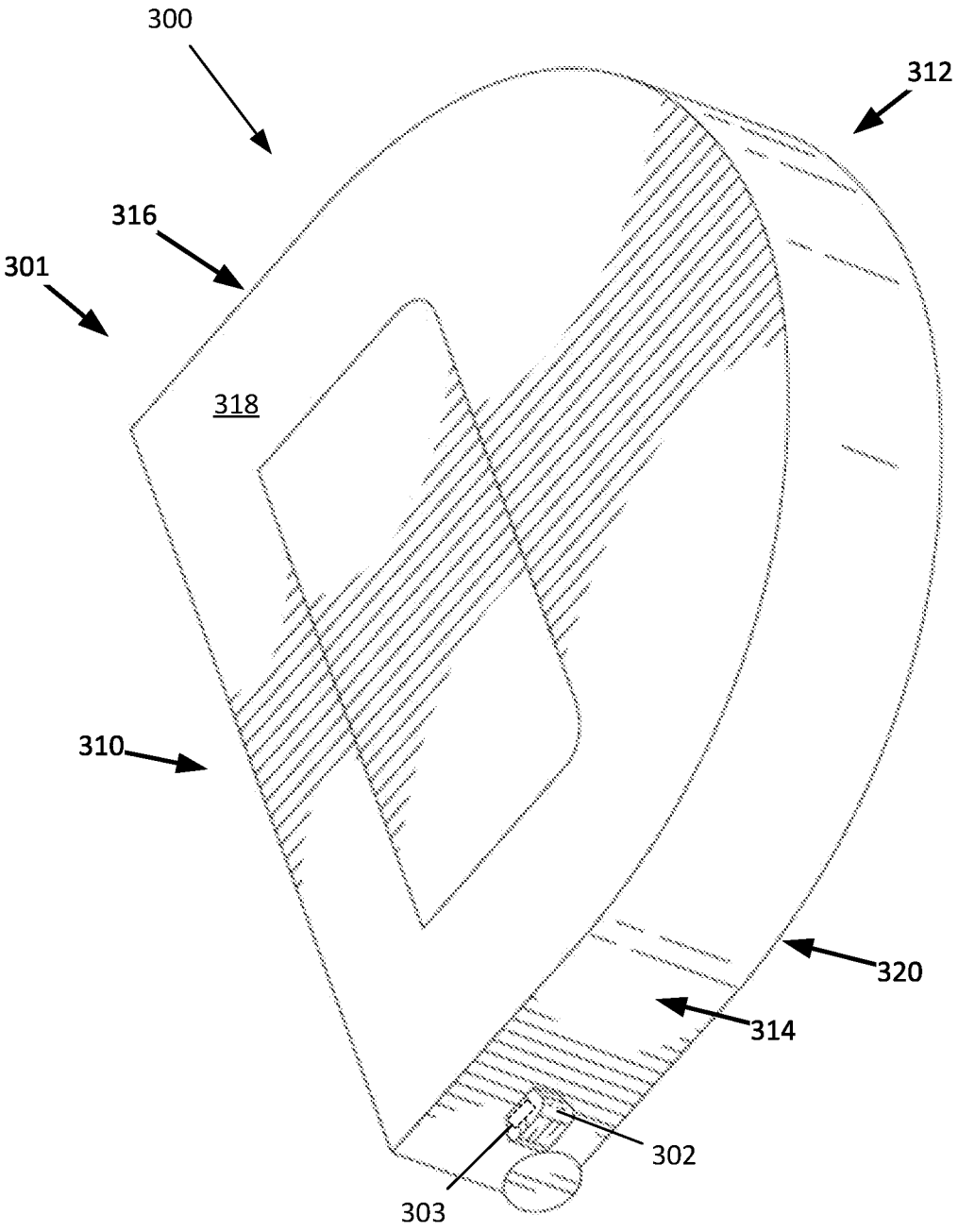
FIG. 3 is a perspective view of another example of the robotic cleaner of FIG. 1, consistent with embodiments of the present disclosure.

FIG. 3 shows a perspective view of a robotic cleaner 300, which may be an example of the robotic cleaner 101 of FIG. 1. As shown, the robotic cleaner 300 includes a housing 301 having a front side 310, a back side 312 that is opposite the front side 310, a left side 314, a right side 316 that is opposite the left side 314, an upper side (or top surface) 318, and an underside (or bottom surface) 320 that is opposite the top surface 318. One or more projections 302 may extend from the housing 301. In some instances, the one or more projections 302 may define a distal most portion of the robotic cleaner 300. In other instances, the one or more projections 302 may not define a distal most portion of the robotic cleaner 300.

The one or more projections 302 may include and/or be configured to actuate one or more sensors 303. For example, the one or more sensors 303 may include one or more cliff sensors configured to detect a non-traversable drop-off in the surface to be cleaned (or cliff). When the projections 302 are not the distal most portion of the robotic cleaner 300, the projections 302 may include one or more reflectors configured to enable corresponding cliff sensors to transmit and receive cliff detection signals to and from the surface to be cleaned. For example, for an infrared (IR) cliff sensor, the one or more projections 302 may include a mirrored surface configured to direct IR emissions towards the surface to be cleaned. Additionally, or alternatively, the one or more projections 302 may be configured to transition between an extended and retracted position such that the one or more projections 302 are configured to transition towards a retracted position in response to contacting an obstacle. When in the retracted position, the one or more projections 302 may be configured to actuate at least one of the one or more sensors 303, wherein actuation of the sensor 303 causes the sensor 303 to generate a signal indicating an obstacle has been encountered. In other words, when transitioning into the retracted position, the one or more projections 302 may cause an obstacle detection signal to be generated. In some instances, the robotic cleaner 300 may include a plurality of projections 302 that are spaced around the housing 301.

The one or more projections 302 may extend from the housing 301 at a position between the top surface 318 and the bottom surface 320. For example, the one or more projections 302 may be centrally disposed between the top and bottom surface 318 and 320. By way of further example, the projections 302 may be disposed at a position closer to the top surface 318 than the bottom surface 320. By way of still further example, the projections 302 may be disposed at a position closer to the bottom surface 320 than the top surface 318.

Figure 4A:
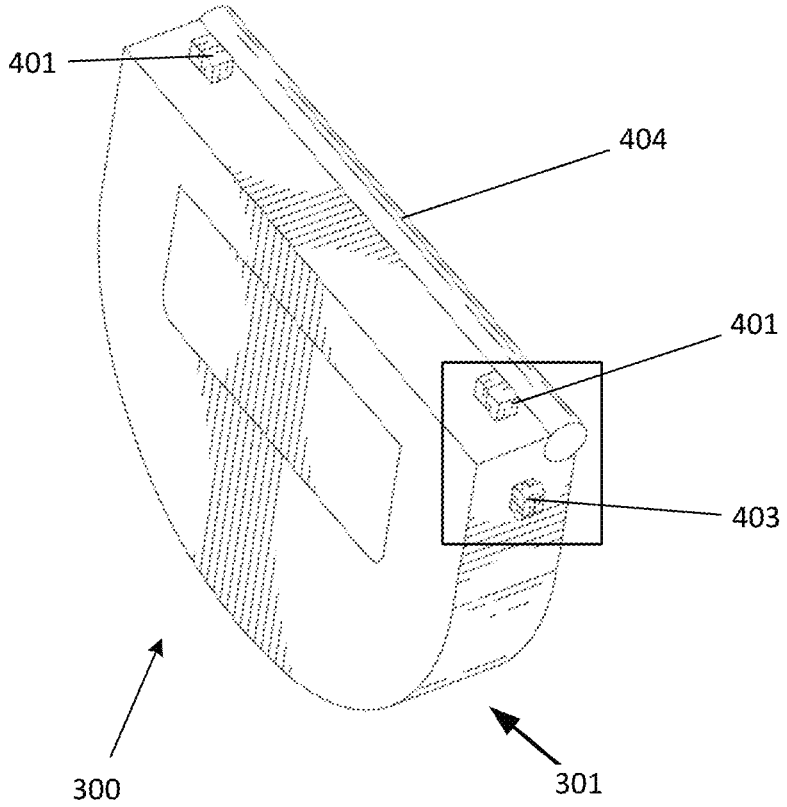
FIG. 4A is another perspective view of the robotic cleaner of the robotic cleaner of FIG. 3 having projections, consistent with embodiments of the present disclosure.
Figure 5:
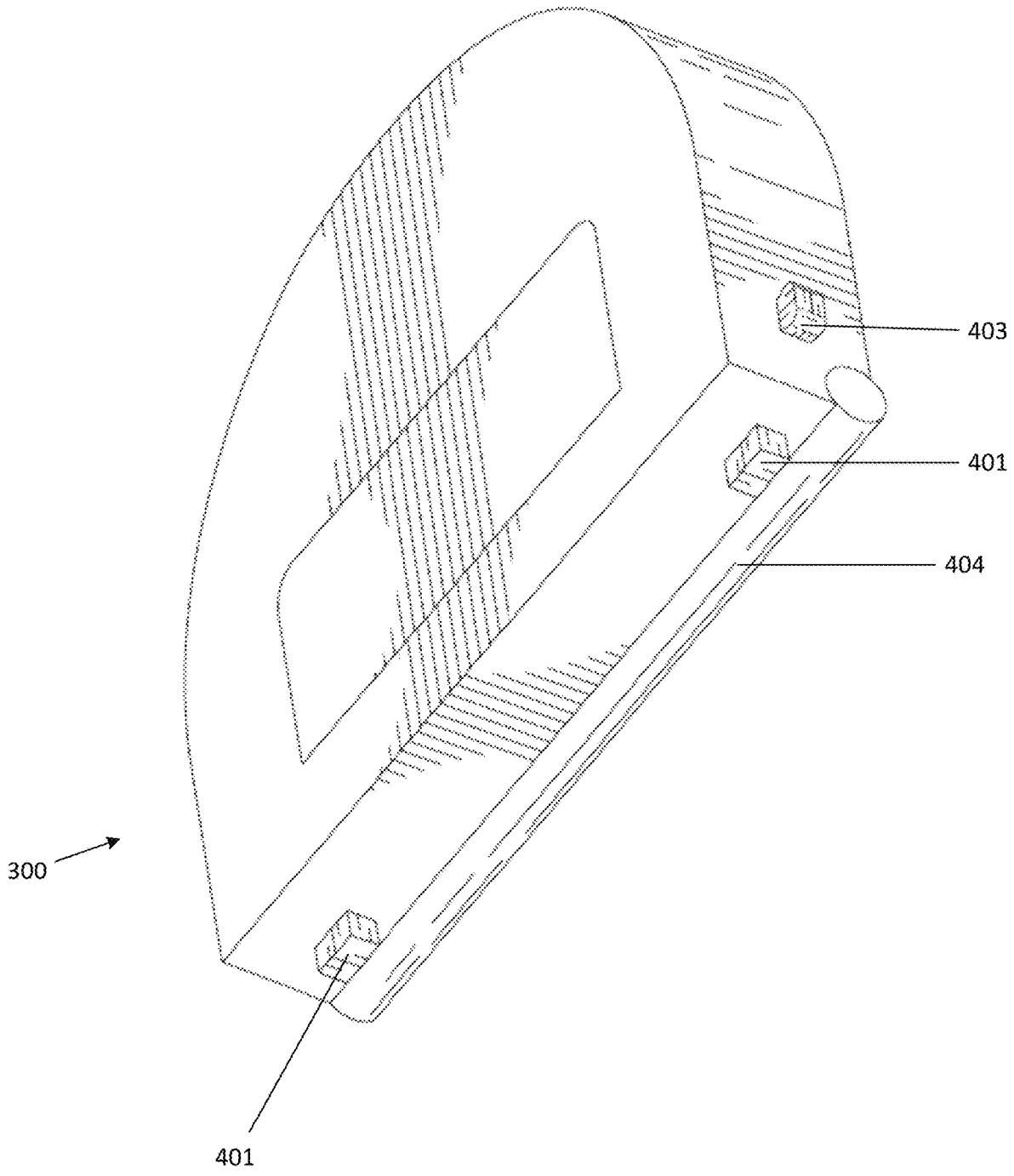
FIG. 5 is a top perspective view of the robotic cleaner of FIG. 4A, consistent with embodiments of the present disclosure.

FIGS. 4A and 5 show a schematic example of the robotic cleaner 300 having a plurality of projections 302. As shown, the plurality of projections 302 include at least one forward projection 401 and at least one a side projection 403. The projections 401 and 403 include cliff sensors configured to detect a non-traversable drop-off (e.g., stairs) in the surface to be cleaned. The forward projection 401 extends from the front side 310 of the housing 301 and each side projection 403 extends from a respective one of the left side 314 or the right side 316.

The projections 401 and 403 are displaceable such that the projections 401 transition between extended and retracted positions (e.g., in response to engaging an obstacle). The projections 401 and 403 can be biased (e.g., using one or more springs) towards the extended position. As such, after disengaging an obstacle (e.g., a wall), the projections 401 and 403 transition towards the extended position. When transitioning between the extended and retracted positions, the projections 401 and 403 may move within a plane that extends substantially parallel to the top surface 318 of the housing 301 (e.g., a horizontal plane).

When in the extended position, the projections 401 and 403 may represent the distal most portions of the robotic cleaner 300. When in the retracted position, the projections 401 and 403 may not be the distal most portion of the robotic cleaner 300. For example, an agitator 404 of the robotic cleaner 300 may define the forward most portion of the robotic cleaner 300 (or the distal most portion in the forward direction) when the forward projection 401 is in the retracted position and, when the forward projection 401 is in the extended position, the forward projection 401 may extend beyond the agitator 404 such that the forward projection 401 defines the forward most portion of the robotic cleaner 300. Such a configuration may allow the agitator 404 to engage (e.g., contact) an obstacle (e.g., a wall) extending from a surface to be cleaned. By way of further example, the agitator 404 of the robotic cleaner 300 may define the left and/or right most portions of the robotic cleaner 300 (or the distal most portion in the left and/or right direction) when the side projection 403 is in the retracted position and, when the side projection 403 is in the extended position, the side projection 403 may extend beyond the agitator 404 such that the side projection 403 defines the left and/or right most portions of the robotic cleaner 300.

When the projections 401 and/or 403 transition into the retracted position, the projections 401 and/or 403 may actuate a respective sensor 303 (e.g., a switch such as a mechanical or optical switch) that generates a signal that is indicative of an obstacle being contacted. When the signal is received by a controller of the robotic cleaner 300, the controller may cause the robotic cleaner 300 to engage in one or more behaviors (e.g., obstacle avoidance, obstacle cleaning, and/or any other behavior).

Figure 4B:
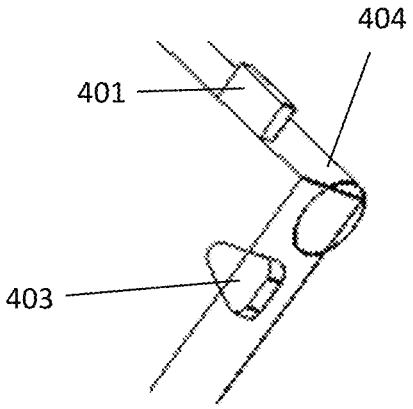
FIG. 4B is a magnified view of a portion of the robotic cleaner of FIG. 4A, illustrating the projections in greater detail, consistent with embodiments of the present disclosure.

FIG. 4B shows a magnified perspective view of a portion of the robotic cleaner 300. As shown, the forward projection 401 may move linearly when transitioning between the extended and retracted positions and the side projection 403 may move pivotally when transitioning between the extended and retracted positions. However, other configurations are possible. For example, when transitioning between the extended and retracted positions, both projections 401 and 403 may move linearly, both projections 401 and 403 may move pivotally, or the forward projection 401 may move pivotally and the side projection 403 may move linearly.

Figure 4C:
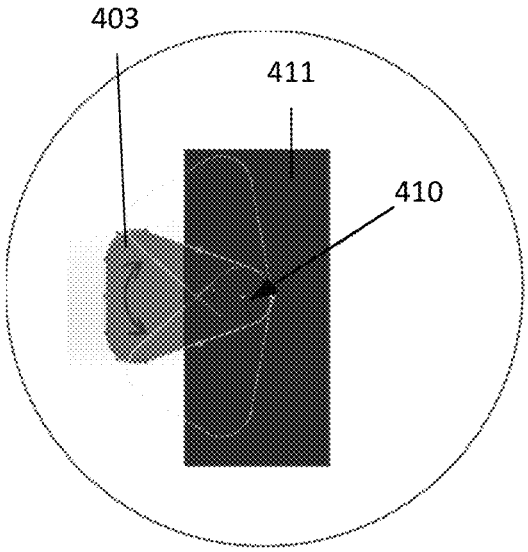
FIG. 4C is a magnified cross-sectional view illustrating an example of one of the projections of FIG. 4B in greater detail, consistent with embodiments of the present disclosure.

FIG. 4C shows a schematic example of the side projection 403, wherein the side projection 403 is configured to pivot about a pivot point 410. The pivot point 410 may be disposed within the housing 301 of the robotic cleaner 300 (e.g., the side projection 403 may be pivotally coupled to a chassis 411 of the robotic cleaner 300) such that, when transitioning into the retracted position, at least a portion of the side projection 403 moves into the housing 301. A biasing mechanism (e.g., a spring) may urge the side projection 403 to pivot towards the extended position. When the side projection 403 encounters an obstacle, the side projection 403 is caused to pivot towards the retracted position. As shown, the side projection 403 may pivot in a substantially horizontal plane between the retracted and extended positions.

As also shown in FIG. 4C, the side projection 403 may have a triangular shape, wherein the triangular shape may have rounded points. Such a configuration may encourage the transition of the side projection 403 between the extended position and the retracted position in response to engaging an obstacle. Other shapes are also within the scope of the present disclosure including, for example, oval, octagonal, or any other shape.

Figure 6:
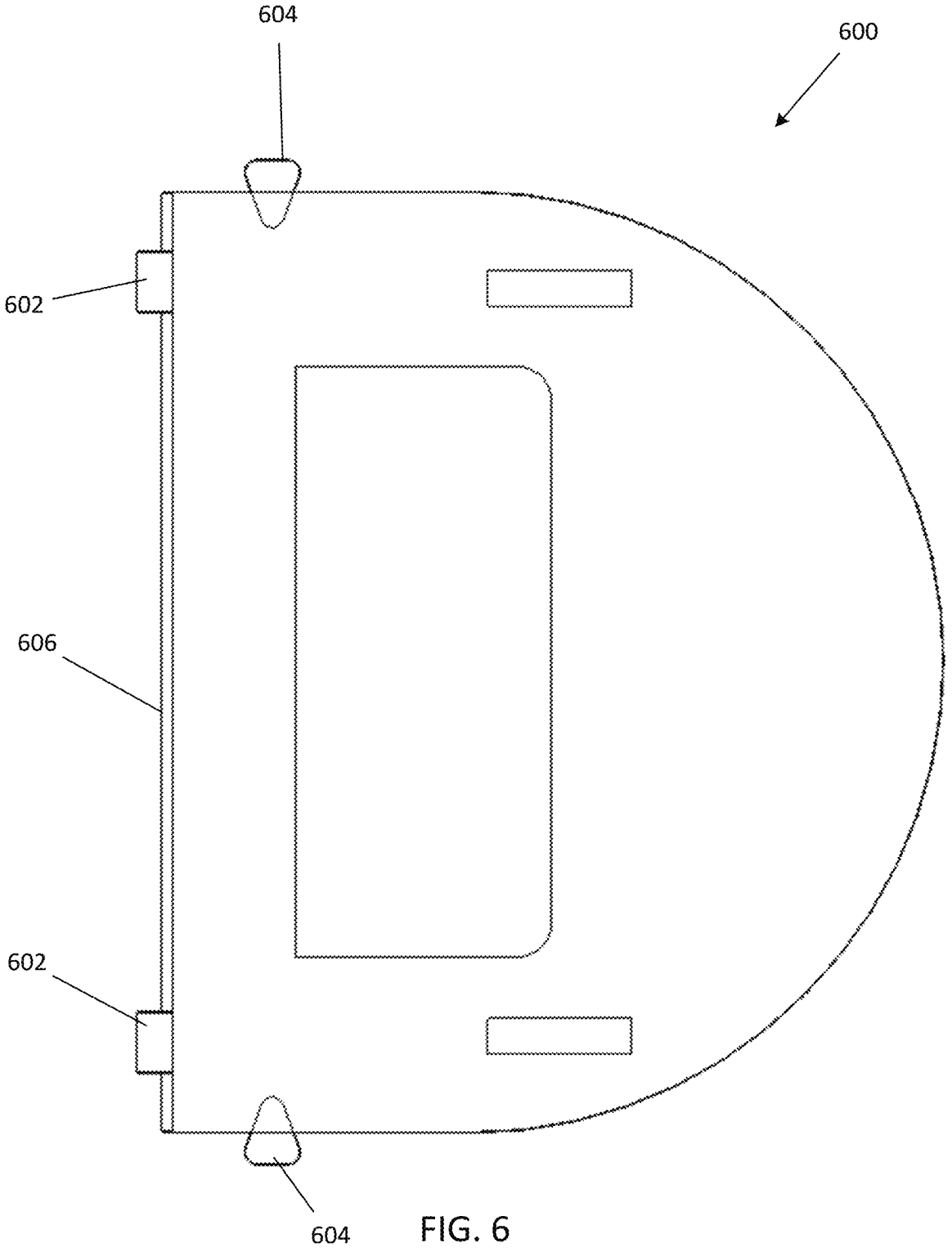
FIG. 6 is a cross-sectional view of a robotic cleaner, consistent with embodiments of the present disclosure.
Figure 7:
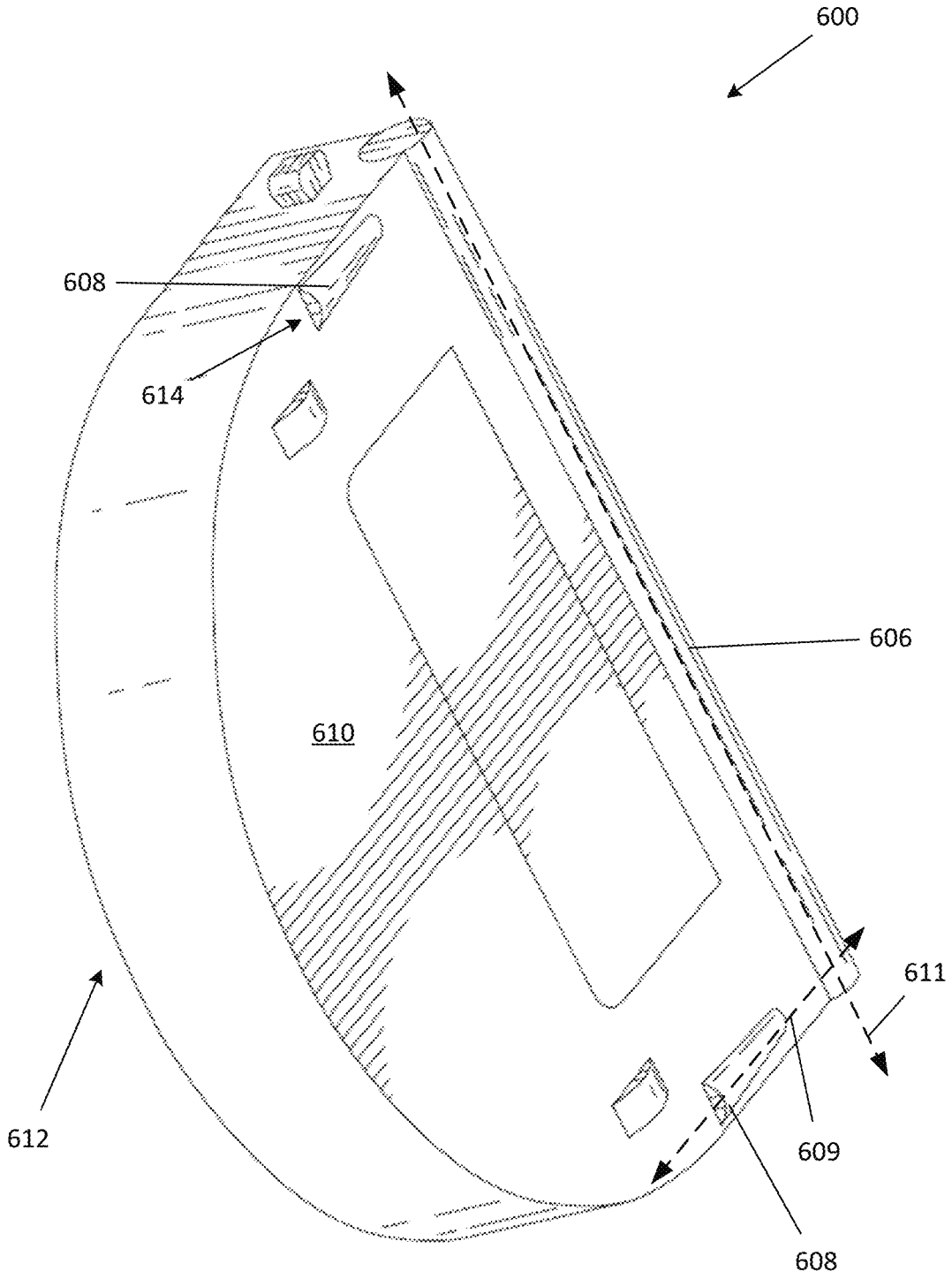
FIG. 7 is a bottom perspective view of the robotic cleaner of FIG. 6, consistent with embodiments of the present disclosure.
Figure 8:
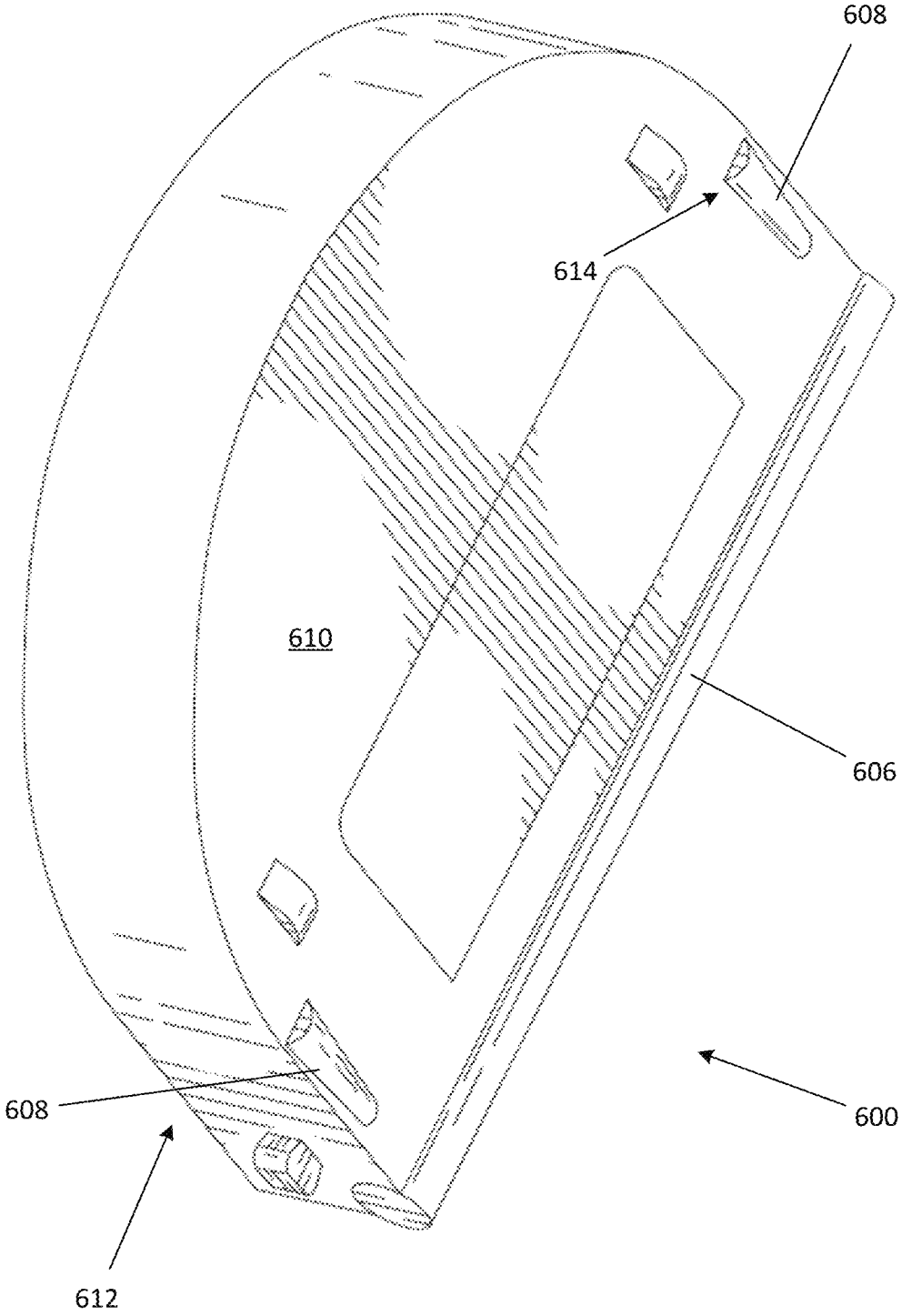
FIG. 8 is another bottom perspective view of the robotic cleaner of FIG. 6, consistent with embodiments of the present disclosure.
Figure 9:
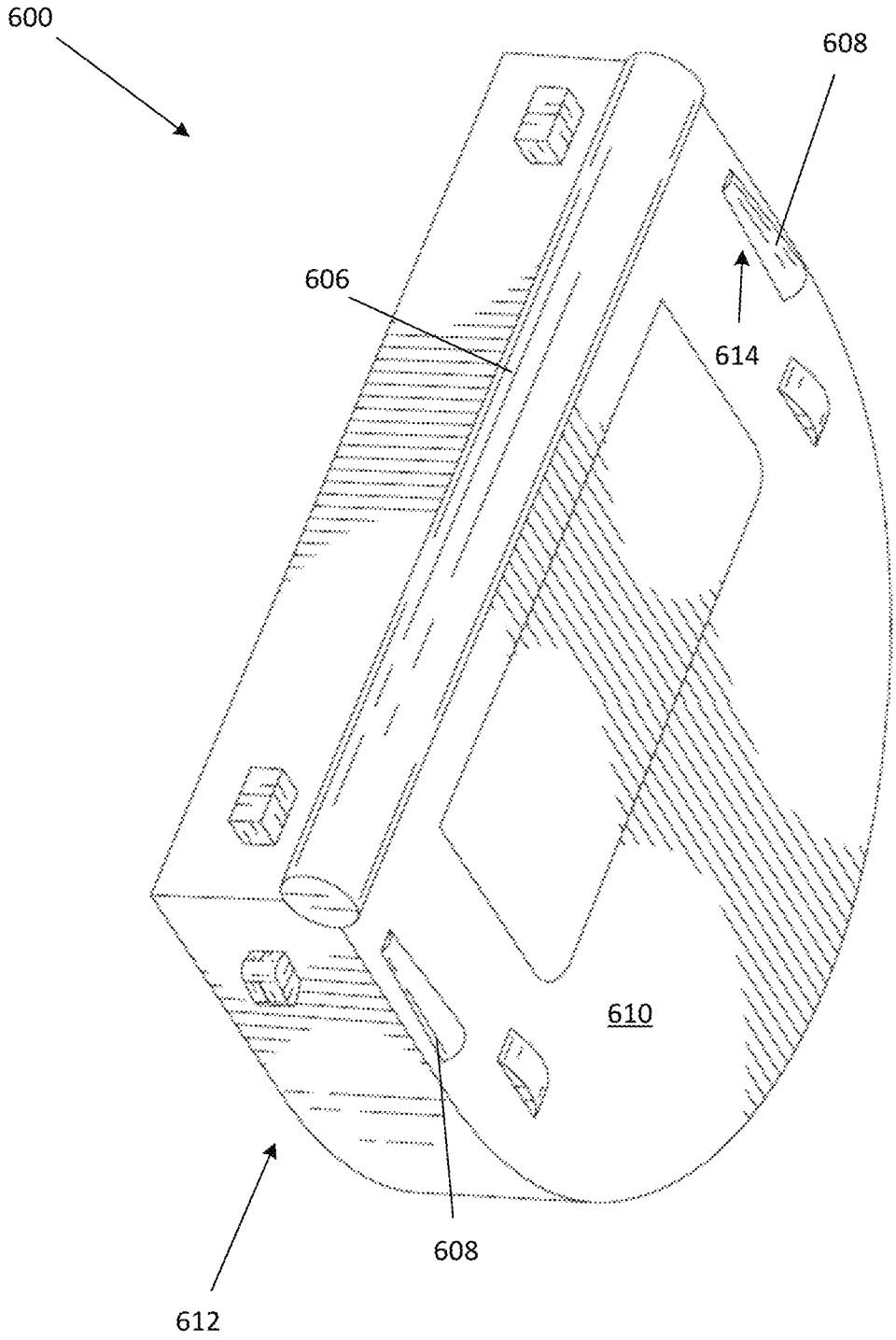
FIG. 9 is a front perspective view of the robotic cleaner of FIG. 6, consistent with embodiments of the present disclosure.
Figure 10:
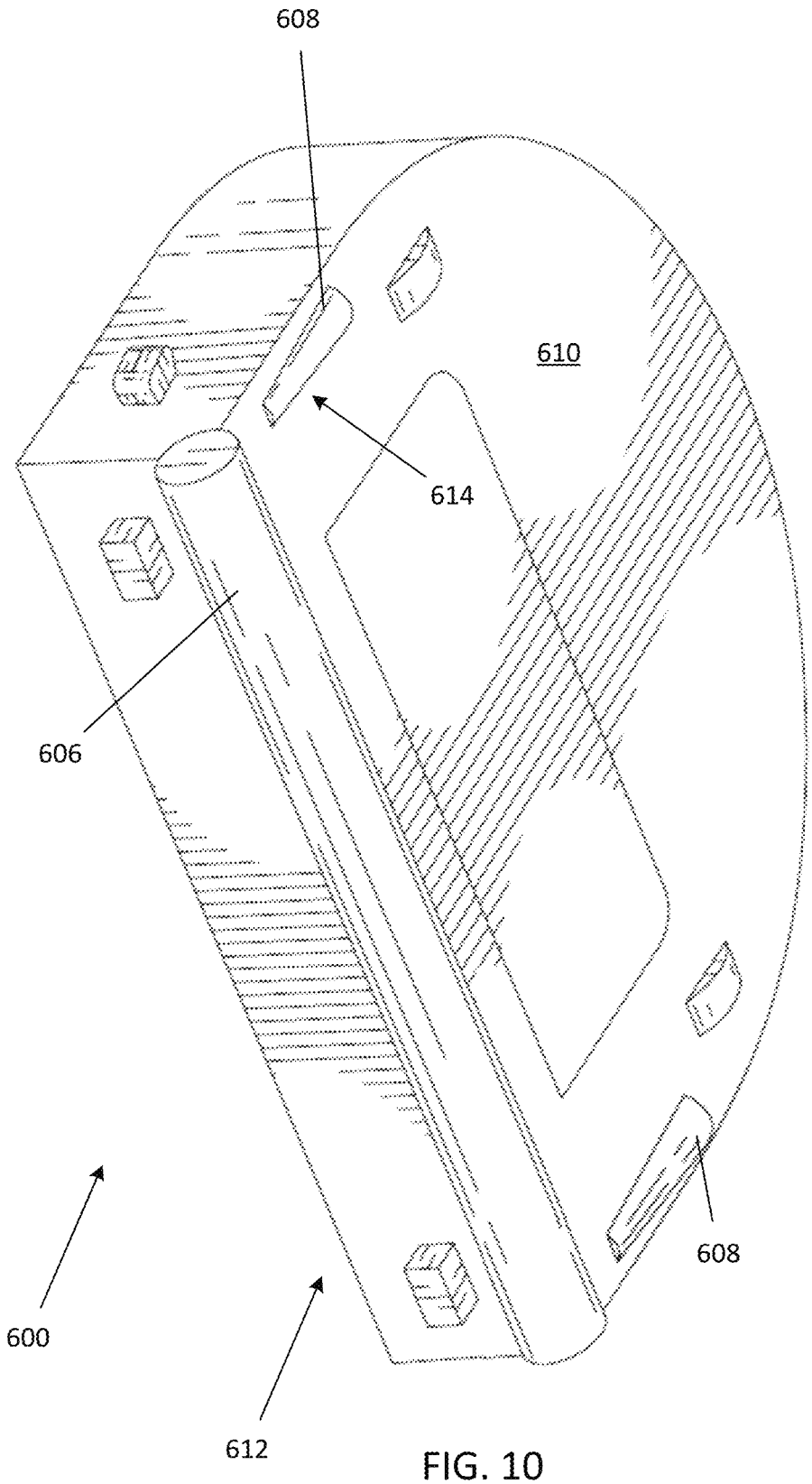
FIG. 10 is another front perspective view of the robotic cleaner of FIG. 6, consistent with embodiments of the present disclosure.
Figure 11:
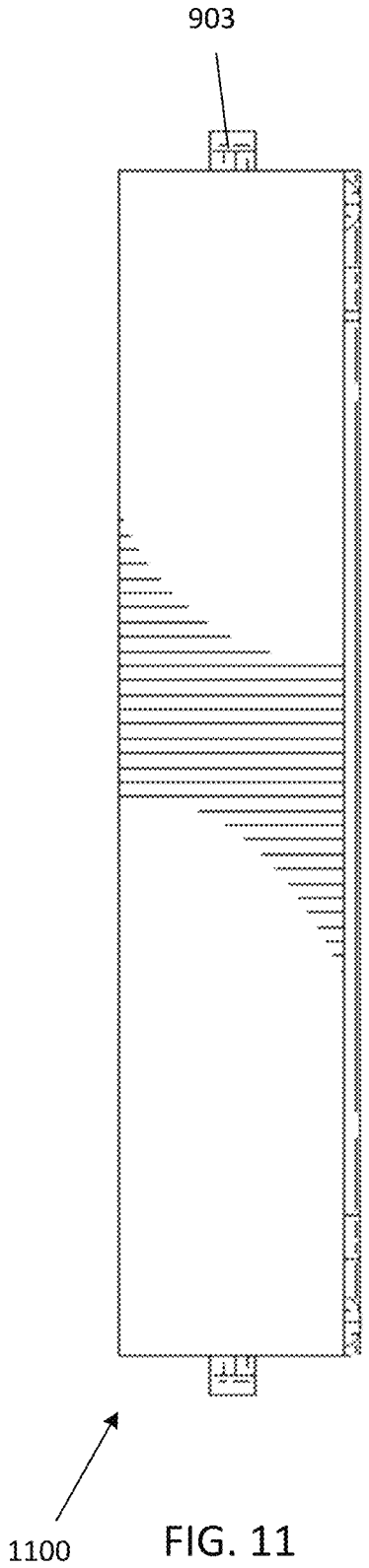
FIG. 11 is a rear view of a robotic cleaner, consistent with embodiments of the present disclosure.
Figure 12:
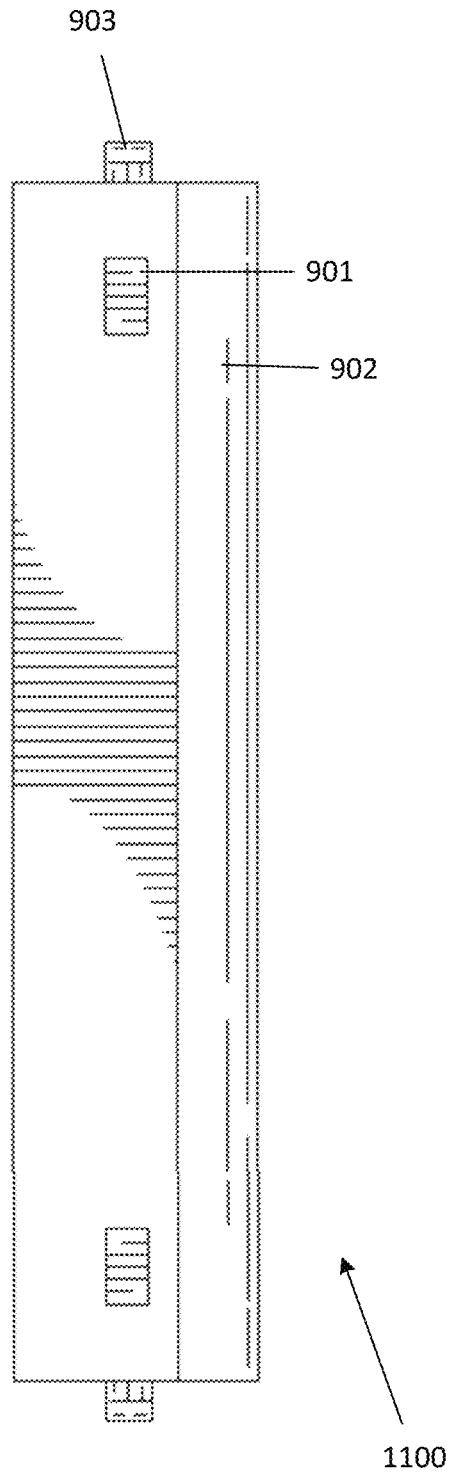
FIG. 12 is a front view of the robotic cleaner of FIG. 11, consistent with embodiments of the present disclosure.
Figure 13:
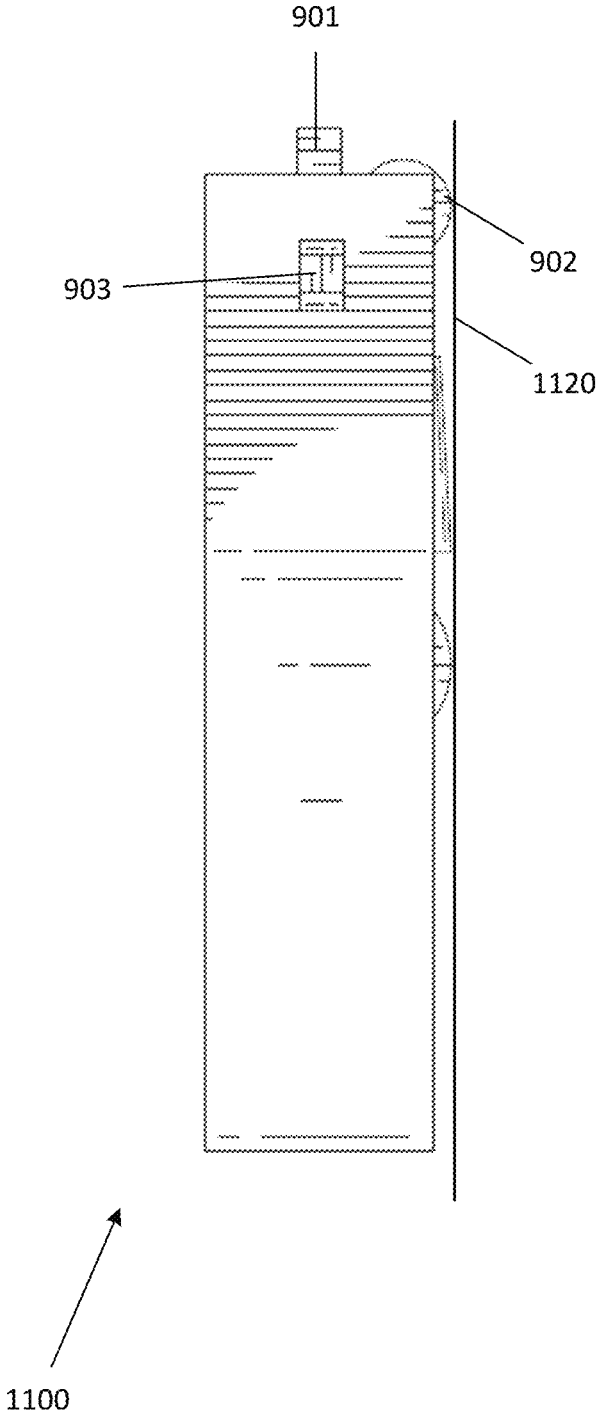
FIG. 13 is a right view of the robotic cleaner of FIG. 11, consistent with embodiments of the present disclosure.
Figure 14:
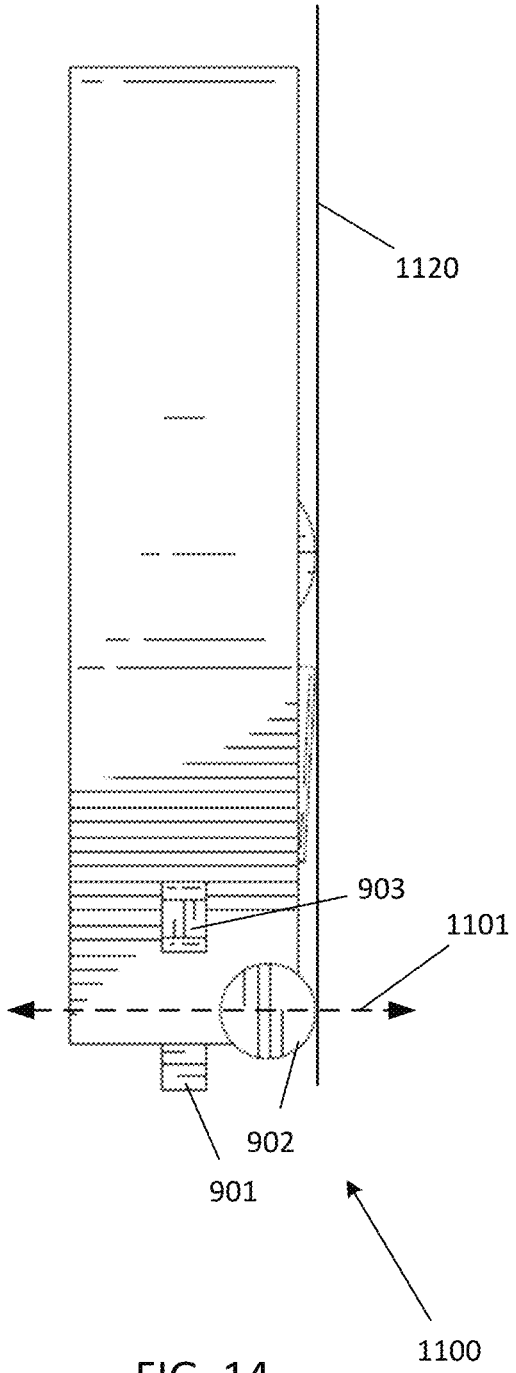
FIG. 14 is a left view of the robotic cleaner of FIG. 11, consistent with embodiments of the present disclosure.
Figure 15:
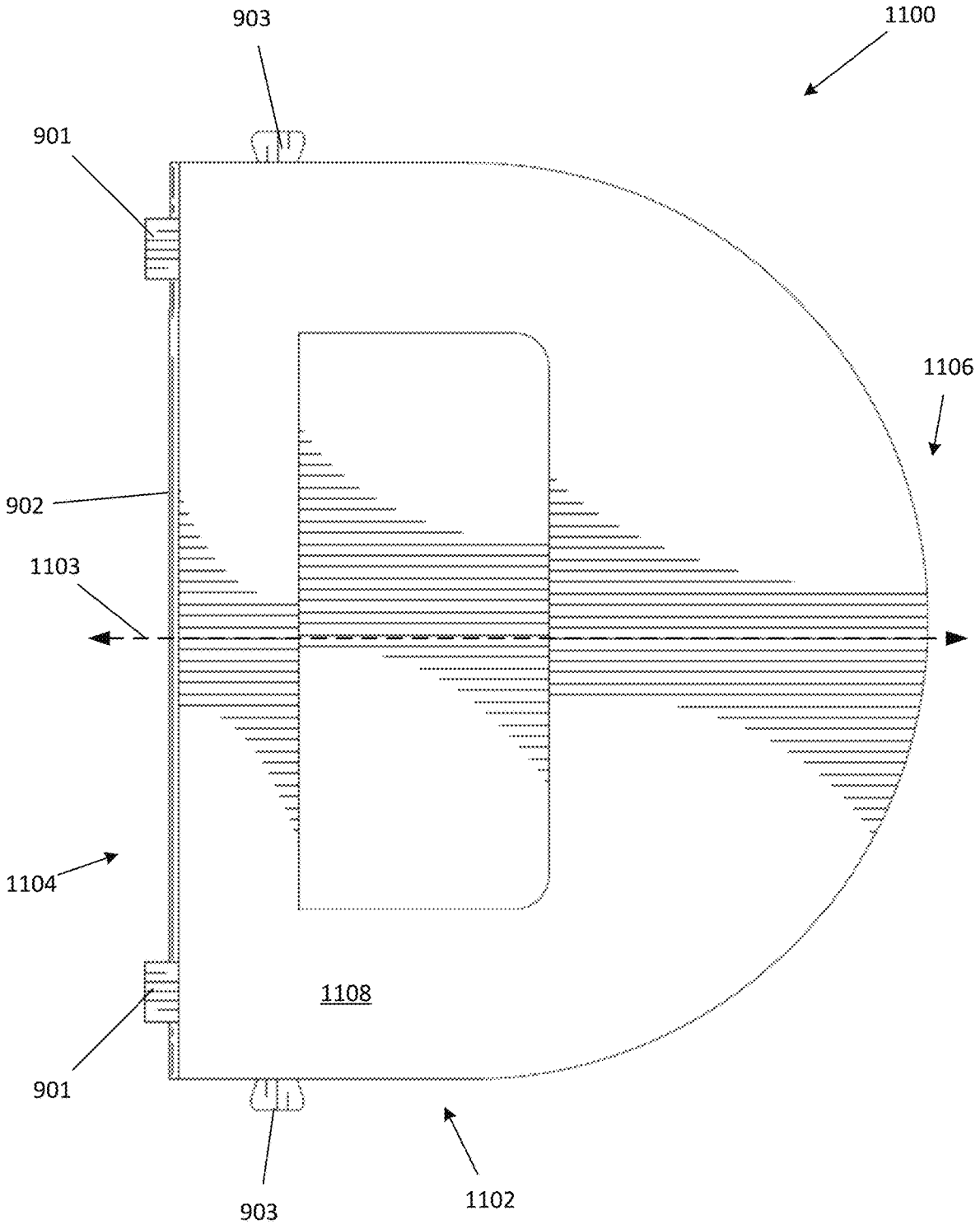
FIG. 15 is a top view of the robotic cleaner of FIG. 11, consistent with embodiments of the present disclosure.
Figure 16:
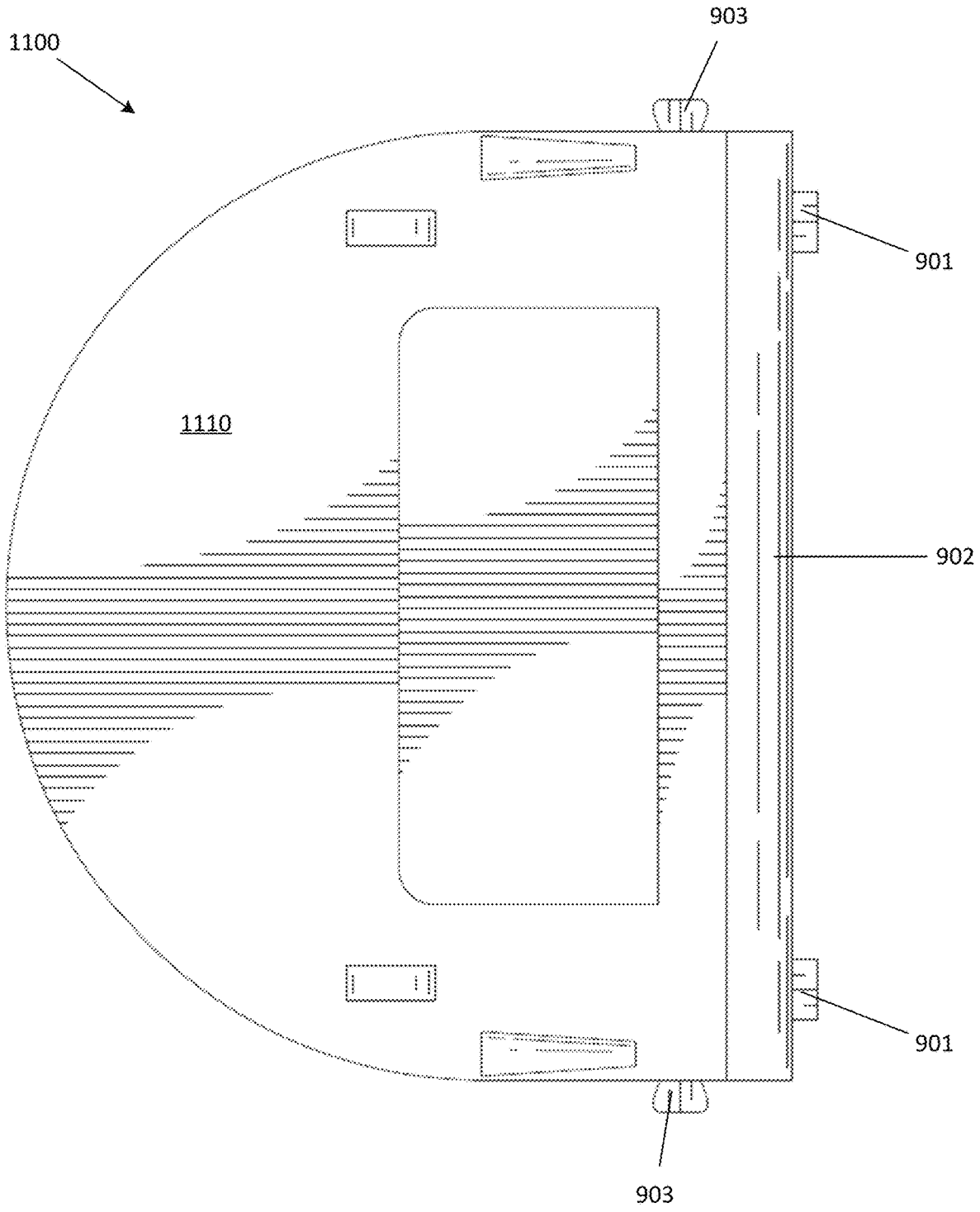
FIG. 16 is a bottom view of the robotic cleaner of FIG. 11, consistent with embodiments of the present disclosure.

FIG. 6 shows a schematic cross-sectional view of a robotic cleaner 600, which may be an example of the robotic cleaner 300 of FIG. 3. As shown, the robotic cleaner 600 may include a plurality of forward projections 602 and a plurality of side projections 604, which may be examples of the forward and side projections 401 and 403, respectively. One or more of the forward and/or side projections 602 and 604 are configured to transition between extended and retracted positions in response to engaging an obstacle. At least one of the forward and/or side projections 602 and 604 extend beyond an agitator 606 when in the extended position. The agitator 606 may extend beyond at least one of the forward and/or side projections 602 and 604 when an obstacle causes a respective projection 602 or 604 to transition to the retracted position.

FIGS. 7-10 show various perspective bottom views of the robotic cleaner 600 of FIG. 6. As shown, the robotic cleaner 600 includes one or more spiral brushes 608 configured to rotate about a spiral brush rotation axis 609. The spiral brush rotation axis 609 is configured to extend substantially parallel to a bottom surface 610 of a housing 612 of the robotic cleaner 600 and/or to a surface to be cleaned. As shown, the one or more spiral brushes 608 extend along the spiral brush rotation axis 609 in a direction transverse (e.g., perpendicular) to a longitudinal length of the agitator 606. In other words, the spiral brush rotation axis 609 may extend transverse (e.g., perpendicular) to an agitator rotation axis 611 about which the agitator 606 rotates. In some instances, the spiral brush rotation axis 609 may intersect the agitator 606. The agitator rotation axis 611 may extend substantially parallel to the bottom surface 610 and/or to a surface to be cleaned. As such, in some instances, the agitator rotation axis 611 and the spiral brush rotation axis 609 may generally be described as being horizontal rotation axes.

The transverse positioning (relative to the agitator 606) of one or more spiral brushes 608 may allow for cleaning transverse to the agitator 606. For example, such a configuration may allow the robotic cleaner 600 to clean alongside an obstacle or drop-off using the one or more spiral brushes 608. Such a configuration may generally be described as creating a longer agitating surface along the edge of the obstacle or drop-off.

The one or more spiral brushes 608 may have a frustoconical shape about which one or more cleaning elements may extend. However, the one or more spiral brushes 608 may have any shape including cylindrical, octagonal, and/or any other shape. The cleaning elements may include any one or more of bristles, flaps, fabric (e.g., a velvet or microfiber), and/or any other cleaning element. For example, the one or more spiral brushes 608 may include at least one strip of bristles and at least one elastomeric flap extending along a body of the one or more spiral brushes 608 (e.g., in a helical pattern). Rotation of the one or more spiral brushes 608 causes the cleaning elements to engage the surface to be cleaned such that debris on the surface is urged towards a suction conduit. Rotation of the spiral brush 608 can be caused by one or more spiral brush motors.

The one or more spiral brushes 608 may be received within a spiral brush cavity 614, wherein at least a portion of the one or more spiral brushes 608 extend from an open end of the spiral brush cavity 614 in a direction of a surface to be cleaned. The spiral brush cavity 614 may include one or more couplings for rotatably coupling the one or more spiral brushes 608 to the housing 612. At least one of the one or more couplings may couple the one or more spiral brushes 608 to a respective spiral brush motor. In some instances, the one or more spiral brushes 608 may be removably coupled to the housing 612. Such a configuration may allow the one or more spiral brushes 608 to be more easily cleaned and/or replaced. Replacement of the one or more spiral brushes 608 may allow a user to select a spiral brush based on a desired cleaning behavior (e.g., a spiral brush with different cleaning elements and/or different size/shape). In some instances, the one or more spiral brushes 608 may be removed entirely and the robotic cleaner 600 may be configured to operate without the one or more spiral brushes.

FIGS. 11-16 show schematic examples of a robotic cleaner 1100, which may be an example of the robotic cleaner 101 of FIG. 1. As shown, the robotic cleaner 1100 includes a housing 1102 and an agitator 902 configured to be rotated relative to the housing 1102. The agitator 902 can be configured to detect engagement with an obstacle and/or an existence of a non-traversable drop-off (or cliff). For example, the agitator 902 can be configured to move along one or more of a drop axis 1101 and/or a forward bump axis 1103, wherein movement along the drop axis 1101 and/or the forward bump axis 1103 may be configured to actuate a sensor (e.g., an optical or mechanical switch), generating a detection signal, after a predetermined amount of movement. As such, movement of the agitator 902 along the forward bump axis 1103 may be indicative of a presence of an obstacle extending from a surface to be cleaned 1120, wherein the obstacle impedes forward movement of the robotic cleaner 1100, and movement of the agitator 902 along the drop axis 1101 may be indicative of a presence of a non-traversable drop-off (or cliff). Therefore, in some instances, the agitator 902 may generally be described as providing obstacle and/or drop-off sensing. When the agitator 902 moves along both the drop axis 1101 and the forward bump axis 1103, the agitator 902 may be generally be described as being configured to float.

The forward bump axis 1103 extends substantially parallel to a direction of forward movement of the robotic cleaner 1100 and the drop axis 1101 extends substantially perpendicular to a surface to be cleaned 1120. In other words, the forward bump axis 1103 extends transverse (e.g., perpendicular) to a front side 1104 and a back side 1106 of the housing 1102 of the robotic cleaner 1100 and the drop axis 1101 extends transverse (e.g., perpendicular) to an upper side 1108 and an underside 1110 of the housing 1102. As such, when the agitator 902 is capable of moving along both the forward bump axis 1103 and the drop axis 1101, the forward bump axis 1103 may generally be described as extending transverse (e.g., perpendicular) to the drop axis 1101. In some instances, the forward bump axis 1103 may generally be described as being a horizontal axis and the drop axis 1101 may generally be described as being a vertical axis.

In some instances, movement of the agitator 902 along one or more of the drop axis 1101 and/or the forward bump axis 1103 may be caused by movement of a sole plate. For example, the agitator 902 may be rotatably coupled to the sole plate such that a movement of the sole plate is transferred to the agitator 902. In this example, when the robotic cleaner 1100 encounters a non-traversable drop-off, the sole plate may move along the drop axis 1101 along with the agitator 902. Alternatively, the sole plate may move independently from the agitator 902 (e.g., the agitator may be fixed relative to the drop axis 1101 and the forward bump axis 1103) such that movement of the sole plate is indicative of the presence of an obstacle and/or a non-traversable drop-off. Movement of the sole plate may actuate a sensor (e.g., switch) configured to generate a signal indicative of a non-traversable drop-off and/or obstacle being encountered.

When the agitator 902 is configured to provide obstacle and/or non-traversable drop-off sensing, additional obstacle and/or non-traversable drop-off sensors may be omitted. For example, one or more forward and/or side projections 901 and/or 903 having cliff sensors may be omitted. Alternatively, for example, the robotic cleaner may include one or more forward and/or side projections 901 and/or 903 having cliff sensors to increase a confidence level in detecting a non-traversable drop-off. Such configurations may allow the agitator 902 to clean the edge of the drop-off before engaging in a cliff avoidance behavior (e.g., turning and/or reversing). By way of further example, when the agitator 902 provides forward obstacle detection, a bumper may be omitted and the agitator 902 may define the forward most portion of the robotic cleaner 1100. Such a configuration may allow the robotic cleaner 1100 to clean at least a portion of a vertically extending surface of the obstacle (e.g., a leg of a piece of furniture such as a chair or a wall) using the agitator 902 before engaging in an obstacle avoidance behavior (e.g., turning and/or reversing).

An example of a robotic cleaner, consistent with the present disclosure, may include a housing, an agitator, and one or more projections. The housing may have a front side, a back side opposite the front side, a left side, and a right side opposite the left side. The right and left sides extend between the front and back sides. The agitator may be configured to rotate about an agitator rotation axis, the agitator rotation axis extending substantially parallel to the front side. The one or more projections may extend from the housing. The one or more projections may include one or more cliff sensors.

In some instances, the one or more projections may include at least one forward projection and at least one side projection, the at least one forward projection extending from the front side of the housing and the at least one side projection extending from a respective one of the left side or the right side of the housing. In some instances, the agitator may extend from the front side of the housing. In some instances, the forward projection may extend beyond the agitator. In some instances, the one or more projections may be configured to transition between an extended position and a retracted position in response to engaging an obstacle. In some instances, when at least one of the one or more projections transition into the retracted position, an obstacle detection signal may be caused to be generated. In some instances, the agitator may be configured to move along at least one of a drop axis or a forward bump axis. In some instances, the agitator may be configured to move along the drop axis and movement along the drop axis may be indicative of a presence of a cliff. In some instances, the agitator may extend from the front side of the housing and may be configured to move along the forward bump axis, movement along the forward bump axis may be indicative of a presence of an obstacle. In some instances, the robotic cleaner may further include a spiral brush configured to rotate about a spiral brush rotation axis, the spiral brush rotation axis extending substantially parallel to a surface to be cleaned and transverse to the agitator rotation axis.

Another example of a robotic cleaner, consistent with the present disclosure, may include a housing having a front side and a back side opposite the front side and an agitator extending from the front side of the housing. The agitator may be configured to rotate about an agitator rotation axis. The agitator rotation axis may extend substantially parallel to the front side. The agitator may be further configured to move along a drop axis and a forward bump axis. Movement along the drop axis may be indicative of a presence of a cliff and movement along the forward bump axis may be indicative of a presence of an obstacle.

In some instances, the robotic cleaner may further include one or more projections extending from the housing and the one or more projections may include one or more cliff sensors. In some instances, the one or more projections may be configured to transition between an extended position and a retracted position in response to engaging an obstacle. In some instances, when at least one of the one or more projections transition into the retracted position, an obstacle detection signal may be caused to be generated. In some instances, the robotic cleaner may further include a spiral brush configured to rotate about a spiral brush rotation axis, the spiral brush rotation axis extending substantially parallel to a surface to be cleaned and transverse to the agitator rotation axis.

Another example of a robotic cleaner, consistent with the present disclosure, may include a housing, an agitator, and a spiral brush. The housing may have a front side and a back side opposite the front side. The agitator may be configured to rotate about an agitator rotation axis. The agitator rotation axis may extend substantially parallel to the front side and substantially parallel to a surface to be cleaned. The spiral brush may be configured to rotate about a spiral brush rotation axis. The spiral brush rotation axis may extend substantially parallel to the surface to be cleaned and transverse to the agitator rotation axis.

In some instances, the robotic cleaner may further include one or more projections extending from the housing and the one or more projections may include one or more cliff sensors. In some instances, the one or more projections may be configured to transition between an extended position and a retracted position in response to engaging an obstacle. In some instances, when at least one of the one or more projections transition into the retracted position, an obstacle detection signal may be caused to be generated. In some instances, the agitator may be further configured to move along a drop axis and a forward bump axis, movement along the drop axis may be indicative of a presence of a cliff and movement along the forward bump axis may be indicative of a presence of an obstacle.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A robotic cleaner comprising:

a housing having a front side and a back side opposite the front side;

an agitator extending from the front side of the housing such that at least a portion of the agitator is exposed, the exposed portion of the agitator defines a forward most portion of the robotic cleaner and is configured to contact an obstacle, the agitator is further configured to rotate about an agitator rotation axis, the agitator rotation axis extends substantially parallel to the front side, the agitator is further configured to move along a drop axis and a forward bump axis, movement along the drop axis actuates a drop sensor, actuation of the drop sensor is indicative of a presence of a cliff and movement along the forward bump axis actuates a bump sensor, actuation of the bump sensor is indicative of a presence of the obstacle; and a spiral brush configured to rotate about a spiral brush rotation axis, the spiral brush rotation axis is configured to extend substantially parallel to a surface to be cleaned and extends transverse to the agitator rotation axis.

2. The robotic cleaner of claim 1 further comprising one or more projections extending from the housing, the one or more projections including one or more cliff sensors.

3. The robotic cleaner of claim 2, wherein the one or more projections are configured to transition between an extended position and a retracted position in response to engaging the obstacle.

4. The robotic cleaner of claim 3, wherein, when at least one of the one or more projections transition into the retracted position, an obstacle detection signal is caused to be generated.

* * * * *